US011608732B2

(12) United States Patent
Samuel et al.

(10) Patent No.: US 11,608,732 B2
(45) **Date of Patent: *Mar. 21, 2023**

(54) PREDICTIVE TORQUE AND DRAG ESTIMATION FOR REAL-TIME DRILLING

(71) Applicant: Landmark Graphics Corporation, Houston, TX (US)

(72) Inventors: Robello Samuel, Cypress, TX (US); Wenjun Huang, Beijing (CN)

(73) Assignee: Landmark Graphics Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/729,545

(22) Filed: Apr. 26, 2022

(65) Prior Publication Data

US 2022/0243576 A1 Aug. 4, 2022

Related U.S. Application Data

(63) Continuation of application No. 16/770,143, filed as application No. PCT/US2019/044211 on Jul. 30, 2019, now Pat. No. 11,326,438.

(51) Int. Cl.

| | |
|---|---|
| ***E21B 45/00*** | (2006.01) |
| ***E21B 44/00*** | (2006.01) |
| ***E21B 44/04*** | (2006.01) |

(52) U.S. Cl.

CPC ..... *E21B 44/04* (2013.01); *E21B 44/00* (2013.01); *E21B 45/00* (2013.01); *E21B 2200/20* (2020.05); *E21B 2200/22* (2020.05)

(58) Field of Classification Search

CPC ..... E21B 45/00; E21B 44/00; E21B 44/02; E21B 44/04; E21B 2200/20

See application file for complete search history.

(56) References Cited

U.S. PATENT DOCUMENTS

| | | | |
|---|---|---|---|
| 4,760,735 | A | 8/1988 | Sheppard et al. |
| 4,972,703 | A | 11/1990 | Ho |

(Continued)

FOREIGN PATENT DOCUMENTS

| | | |
|---|---|---|
| CN | 104564019 | 4/2015 |
| WO | 2009022114 | 2/2009 |
| WO | 2014046668 | 3/2014 |

OTHER PUBLICATIONS

U.S. Appl. No. 16/770,143 , Notice of Allowance, dated Jan. 12, 2022, 9 pages.

(Continued)

*Primary Examiner* — Frederick L Lagman

(74) *Attorney, Agent, or Firm* — Kilpatrick Townsend & Stockton LLP

(57) ABSTRACT

Certain aspects and features relate to a system that includes a drilling tool, a processor, and a non-transitory memory device that includes instructions that are executable by the processor to cause the processor to perform operations. The operations include receiving input data that corresponds to characteristics of at least one of drilling fluid, a drillstring, or a wellbore. The operations also include calculating at least one dynamic sideforce and at least one dynamic, hydraulic force based at least in part on the input data. The operations also include determining an equilibrium solution for an output value using the at least one dynamic sideforce and at least one dynamic, hydraulic force. The operations also include applying the output value to the drilling tool for controlling operation of the drilling tool.

20 Claims, 12 Drawing Sheets

(56) References Cited

U.S. PATENT DOCUMENTS

| | | | | |
|---|---|---|---|---|
| 5,044,198 | A | 9/1991 | Ho | |
| 8,534,380 | B2 | 9/2013 | Sheppard et al. | |
| 8,720,605 | B2 | 5/2014 | Sheppard et al. | |
| 11,326,438 | B2 * | 5/2022 | Samuel | E21B 44/04 |
| 2013/0282342 | A1 | 10/2013 | Bailey et al. | |
| 2017/0306702 | A1 | 10/2017 | Summers et al. | |
| 2018/0003031 | A1 | 1/2018 | Samuel | |

OTHER PUBLICATIONS

PCT Application No. PCT/US2019/044211 , International Preliminary Report on Patentability, dated Feb. 10, 2022, 6 pages.
PCT Application No. PCT/US2019/044211 , International Search Report and Written Opinion, dated Apr. 28, 2020, 9 pages.

* cited by examiner

PREDICTIVE TORQUE AND DRAG ESTIMATION FOR REAL-TIME DRILLING

CROSS-REFERENCE TO RELATED APPLICATIONS

This is a continuation of U.S. application Ser. No. 16/770,143, now issued as U.S. Pat. No. 11,326,438, entitled "PREDICTIVE TORQUE AND DRAG ESTIMATION FOR REAL-TIME DRILLING" and filed on Jun. 5, 2020, which is a National Stage Application of PCT Application No. PCT/US2019/044211, entitled "PREDICTIVE TORQUE AND DRAG ESTIMATION FOR REAL-TIME DRILLING" and filed on Jul. 30, 2019, the contents of each of which are incorporated by reference herein.

TECHNICAL FIELD

The present disclosure relates generally to well systems. More specifically, but not by way of limitation, this disclosure relates to real-time, predictive monitoring of a drilling tool during the drilling of a wellbore and the use of the predictive monitoring to control the drilling tool.

BACKGROUND

A hydrocarbon well includes a wellbore drilled through a subterranean formation. The conditions inside the subterranean formation where the drill bit is passing when the wellbore is being drilled continuously change. For example, the formation through which a wellbore is drilled exerts a variable force on the drill bit. This variable force can be due to the rotary motion of the drill bit, the weight applied to the drill bit, and the friction characteristics of each strata of the formation. A drill bit may pass through many different materials, rock, sand, shale, clay, etc., in the course of forming the wellbore and adjustments to various drilling parameters are sometimes made during the drilling process by a drill operator to account for observed changes. Sometimes the effects of these adjustments are delayed significantly due to drilling fluid inertia, drill pipe elasticity, and distance. Thus, the drill operator makes adjustments based on experience coupled with knowledge of the depth of the drilling tool, type of drill string, and type of formation.

DETAILED DESCRIPTION

Figure 1:
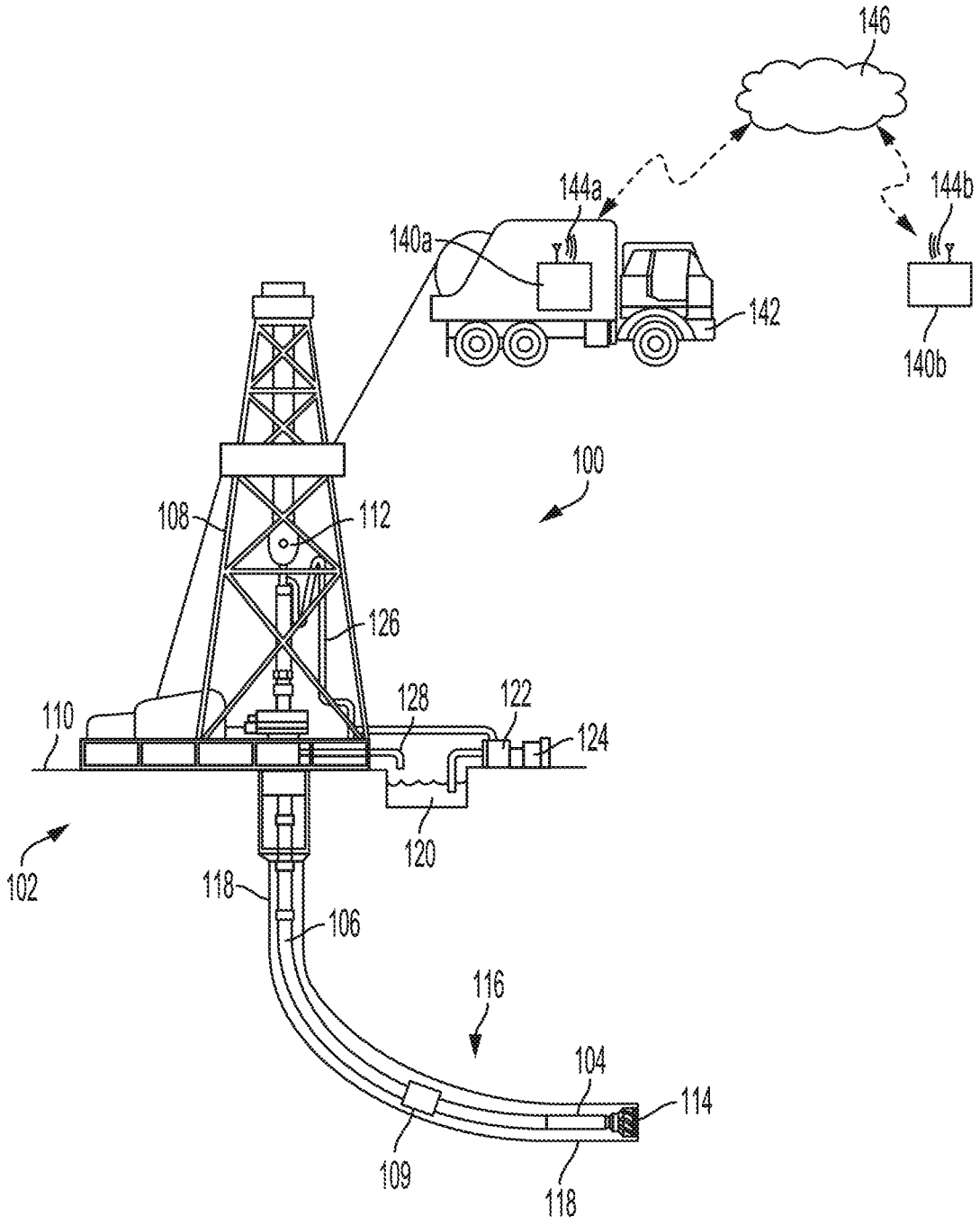
FIG. 1 is a cross-sectional view of an example of a drilling system that includes real-time torque and drag estimation according to some aspects of the disclosure.

Certain aspects and features relate to a system that improves, and makes more efficient, the projection of an output value for a selected drilling parameter to be applied to a drilling tool in real-time. Certain aspects and features select the output value using dynamic force analysis coupled to fluid effects as part of a model that estimates projected torque and drag in order to determine values to apply to a drilling tool during drilling operations.

Accurate projection of forces and stresses is increasingly important as well configurations where the tension must be maintained within narrow limits become more common. These configurations include, as examples, those where running casing operations or coiled tubing operations are used, particularly where these techniques are used in highly undulated wells. Traditional drilling models are highly static in nature. Axial and side forces and thus the hookload on the drill string are determined in traditional models based on assumptions that drill string forces, drill string movement, and drilling mud displacement are constant at a particular depth.

A drilling model according to aspects and features of the present disclosure take into account pipe axial elasticity as it relates to dynamic, force analysis and couples this relationship with drilling fluid effects, taking into account changes over time. The model also takes into account the effects of wellbore deviation and pipe eccentricity. For wells running with close casing tolerance, the model can take into account contact frictional forces related to pipe motion. The model can also take into account fluid movement and pressure losses in an eccentric annulus. The fluid movement and pressure losses in an eccentric annulus are different than those in a concentric annulus.

In some examples, a system includes a drilling tool, at least one sensor disposable with respect to a drillstring in a wellbore, and a processor communicatively coupled to the sensor and the drilling tool. A non-transitory memory device includes instructions that are executable by the processor to cause the processor to perform operations. The operations include receiving input data at least in part using the sensor. The input data corresponds to characteristics of drilling fluid, the drillstring, the wellbore, or a combination of these. The operations further include calculating at least one dynamic sideforce and at least one dynamic, hydraulic force for each interval of time. The calculation is based at least in part on the input data. The operations further include determining an equilibrium solution for an output value using the dynamic sideforce and dynamic, hydraulic force for each time interval. The operations also include applying the output value to the drilling tool for each time interval of the time intervals.

In some examples, the operations further include producing an element matrix. The dynamic sideforce and the dynamic, hydraulic force are calculated using the element matrix. In some example, the hydraulic parameters can include viscous shear, eccentricity, gelation, wellbore expansion, pipe expansion or any combination of these. In some examples, the sideforce parameters include elasticity, friction or both.

In some examples, the operations include determining hookload based on the output value, the dynamic sideforce, and the dynamic, hydraulic force. A plot of the hookload can be displayed to an operator. In some examples, the operations include displaying a graph of effective tension, torque, fatigue, stress, or any combination of these, for example, to an operator viewing a display device. In some examples, the operations include displaying a table or tables of maximum overpull, slack-off, failures or any combination of these.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a drilling system 100 that includes real-time torque and drag estimation according to some aspects of the disclosure. A wellbore of the type used to extract hydrocarbons from a formation may be created by drilling into the earth 102 using the drilling system 100. The drilling system 100 may be configured to drive a bottom hole assembly (BHA) 104 positioned or otherwise arranged at the bottom of a drillstring 106 extended into the earth 102 from a derrick 108 arranged at the surface 110. The derrick 108 includes a kelly 112 used to lower and raise the drillstring 106. The BHA 104 may include a drill bit 114 operatively coupled to a tool string 116, which may be moved axially within a drilled wellbore 118 as attached to the drillstring 106. Tool string 116 may include one or more sensors 109, for determining conditions in the wellbore. Sensors 109 may sense, as examples, temperature and fluid velocity. The sensors can send signals to the surface 110 via a wired or wireless connection (now shown). The combination of any support structure (in this example, derrick 108), any motors, electrical equipment, and support for the drillstring and tool string may be referred to herein as a drilling arrangement.

During operation, the drill bit 114 penetrates the earth 102 and thereby creates the wellbore 118. The BHA 104 provides control of the drill bit 114 as it advances into the earth 102. The combination of the BHA 104 and drill bit 114 can be referred to as a drilling tool. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drillstring 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drillstring 106, and in the process returns the drill cuttings and debris to the surface. The cuttings and mud mixture are passed through a flow line 128 and are processed such that a cleaned mud is returned down hole through the stand pipe 126 once again.

Still referring to FIG. 1, the drilling arrangement and any sensors (through the drilling arrangement or directly) are connected to a computing device 140*a*. In FIG. 1, the computing device 140*a* is illustrated as being deployed in a work vehicle 142, however, a computing device to receive data from sensors and to control drill bit 114 can be permanently installed with the drilling arrangement, be hand-held, or be remotely located. In some examples, the computing device 140*a* can process at least a portion of the data received and can transmit the processed or unprocessed data to another computing device 140*b* via a wired or wireless network 146. The other computing device 140*b* can be offsite, such as at a data-processing center. The other computing device 140*b* can receive the data, execute computer program instructions to provide real-time torque and drag estimation based in part on sensor signals, and communicate parameters to computing device 140*a*.

The computing devices 140*a-b* can be positioned belowground, aboveground, onsite, in a vehicle, offsite, etc. The computing devices 140*a-b* can include a processor interfaced with other hardware via a bus. A memory, which can include any suitable tangible (and non-transitory) computer-readable medium, such as RAM, ROM, EEPROM, or the like, can embody program components that configure operation of the computing devices 140*a-b*. In some aspects, the computing devices 140*a-b* can include input/output interface components (e.g., a display, printer, keyboard, touch-sensitive surface, and mouse) and additional storage.

The computing devices 140*a-b* can include communication devices 144*a-b*. The communication devices 144*a-b* can represent one or more of any components that facilitate a network connection. In the example shown in FIG. 1, the communication devices 144*a-b* are wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication devices 144*a-b* can use acoustic waves, surface waves, vibrations, optical waves, or induction (e.g., magnetic induction) for engaging in wireless communications. In other examples, the communication devices 144*a-b* can be wired and can include interfaces such as Ethernet, USB, IEEE 1394, or a fiber optic interface. The computing devices 140*a-b* can receive wired or wireless communications from one another and perform one or more tasks based on the communications.

Figure 2:
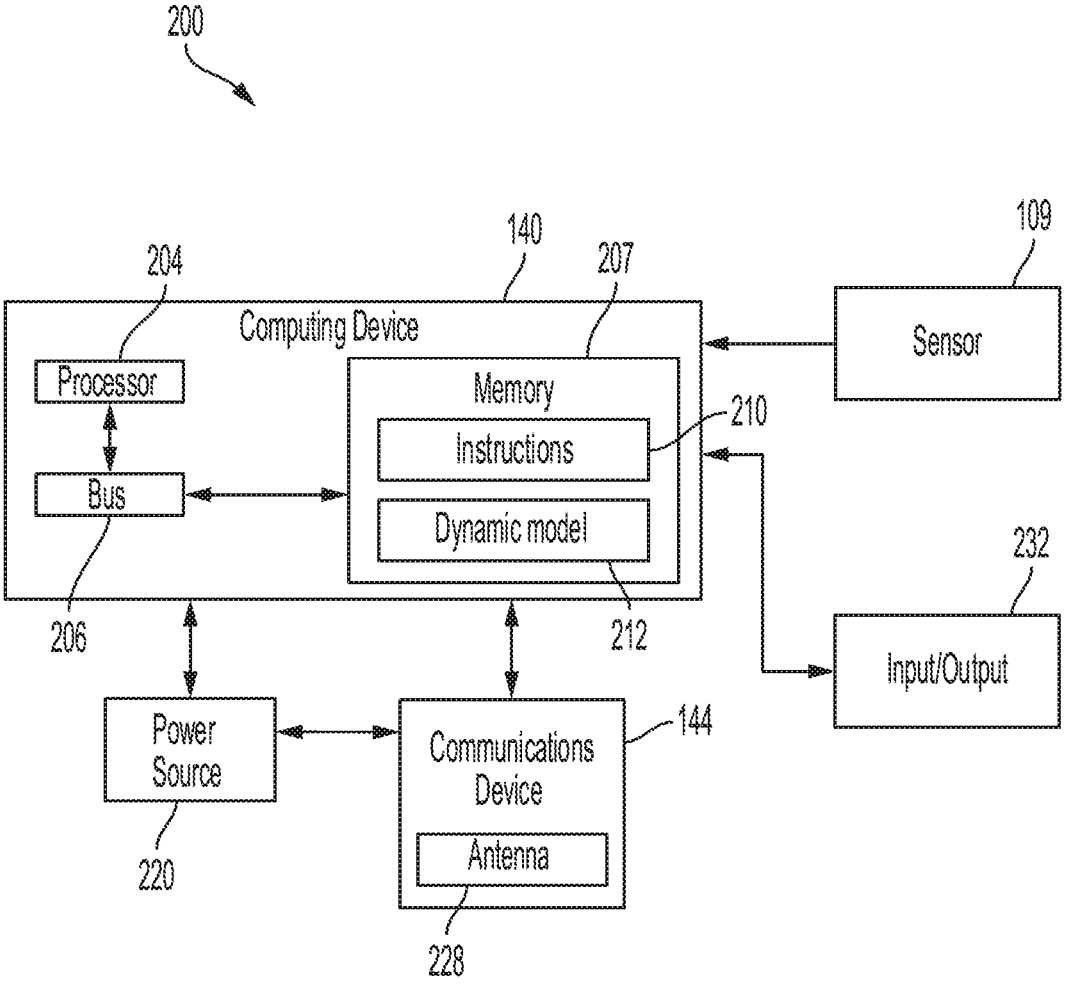
FIG. 2 is a block diagram of a computing system for real-time torque and drag estimation according to some aspects of the disclosure.

FIG. 2 is a block diagram of a computing system 200 for real-time torque and drag estimation according to some aspects of the disclosure. In some examples, the components shown in FIG. 2 (e.g., the computing device 140, power source 220, and communications device 144) can be integrated into a single structure. For example, the components can be within a single housing. In other examples, the components shown in FIG. 2 can be distributed (e.g., in separate housings) and in electrical communication with each other.

The system 200 includes a computing device 140. The computing device 140 can include a processor 204, a memory 207, and a bus 206. The processor 204 can execute one or more operations for real-time torque and drag estimation. The processor 204 can execute instructions stored in the memory 207 to perform the operations. The processor 204 can include one processing device or multiple processing devices or cores. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 include electrically erasable and programmable read-only memory ("EEPROM"), flash memory, or any other type of non-volatile memory. In some examples, at least part of the memory 207 can include a medium from which the processor 204 can read instructions. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

In some examples, the memory 207 can include computer program instructions 210 for real-time torque and drag estimation in part using input data from a sensor 109. These instructions 210 can produce, store, and access a dynamic model 212 that projects torque and drag under various conditions. Computer program instructions 210 can also display estimated torque and drag values or forward those values to other systems using communication device 144, and handle control of any required signaling.

The system 200 can include a power source 220. The power source 220 can be in electrical communication with the computing device 140 and the communications device 144. In some examples, the power source 220 can include a battery or an electrical cable (e.g., a wireline). In some examples, the power source 220 can include an AC signal generator. The computing device 140 can operate the power source 220 to apply a transmission signal to the antenna 228 to forward cutting concentration data to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, part of the communications device 144 can be implemented in software. For example, the communications device 144 can include additional instructions stored in memory 207 for controlling the functions of communication device 144. The communications device 144 can receive signals from remote devices and transmit data to remote devices (e.g., the computing device 140*b* of FIG. 1). For example, the communications device 144 can transmit wireless communications that are modulated by data via the antenna 228. In some examples, the communications device 144 can receive signals (e.g., associated with data to be transmitted) from the processor 204 and amplify, filter, modulate, frequency shift, and otherwise manipulate the signals. In some examples, the communications device 144 can transmit the manipulated signals to the antenna 228. The antenna 228 can receive the manipulated signals and responsively generate wireless communications that carry the data.

The computing system 200 can receive input from sensor(s) 109. Computer system 200 in this example also includes input/output interface 232. Input/output interface 232 can connect to a keyboard, pointing device, display, and other computer input/output devices. An operator may provide input using the input/output interface 232. Projected torque and drag values or other data related to the operation of the system can also be displayed to an operator through a display that is connected to or is part of input/output interface 232. The displayed values can provide an advisory function to a drill operator and the drill operator can make adjustments based on the displayed values. Alternatively, the computer program code instructions 210 can exercise real-time control over the drilling tool through input/output interface 232, altering the weight-on-bit (WOB) or drill speed (RPM) to account for increased or decreased projected torque and drag.

Figure 3:
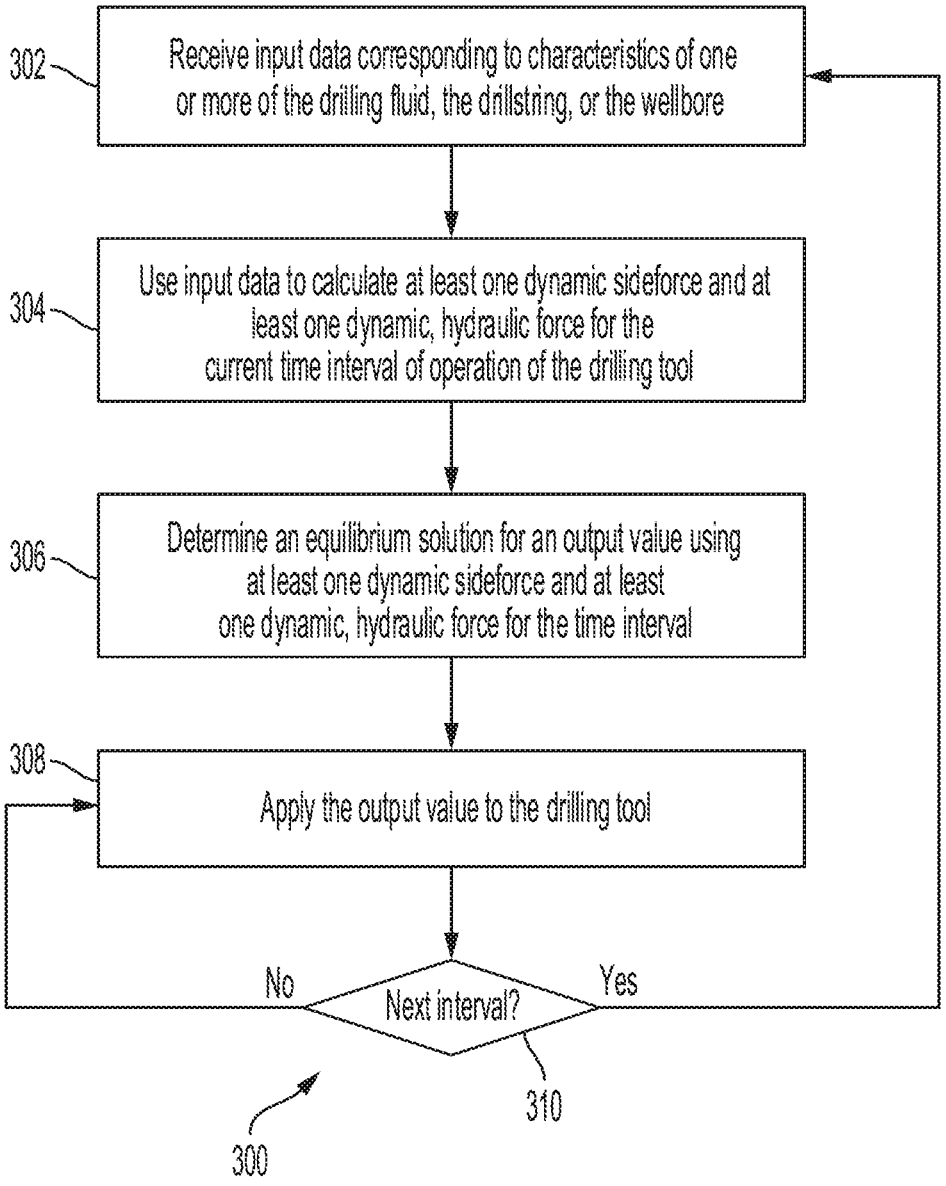
FIG. 3 is a flowchart of a process for real-time torque and drag estimation according to some aspects of the disclosure.

FIG. 3 is an example of a flowchart of a process 300 for real-time projection of torque and drag according to some aspects of the disclosure. At block 302, the processor 204 in computing device 140 receives input data corresponding to characteristics of one or more of the drilling fluid, the drillstring, or the wellbore. At block 304, the processor, using the input data calculates at least one dynamic sideforce and at least one dynamic, hydraulic force for the current time interval of operation of the drilling tool. At block 306, the processor determines an equilibrium solution for an output value using at least one dynamic sideforce and at least one dynamic, hydraulic force for the time interval. At block 308, the processor applies the output value to the drilling tool for the time interval. At block 310, the process repeats for the next time interval.

Aspects and features of the current disclosure are based on a dynamic model, which is described below with reference to FIGS. 4-7. The model adopts a number of assumptions. A tubular string is assumed to be a soft rope with zero bending stiffness. The tubular string is also assumed to be in continuous contact with the wellbore and the deflection of the tubular string is inconsistent with the wellbore axis. Only axial vibration is considered; lateral and torsional vibrations are neglected. The value of the friction factor is related to velocity. Friction factor is determined by velocity direction when velocity is not zero but determined with a tubular equilibrium equation when velocity is zero. It is also assumed that the inner and annular fluid flows are always stable. Pressure vibration of fluid flow is neglected. Note that the first two assumptions are based on a soft string model. Unlike the conventional soft string model however, axial vibration, velocity-dependent friction force, and fluid effect are further considered with the remaining assumptions.

Figure 4:
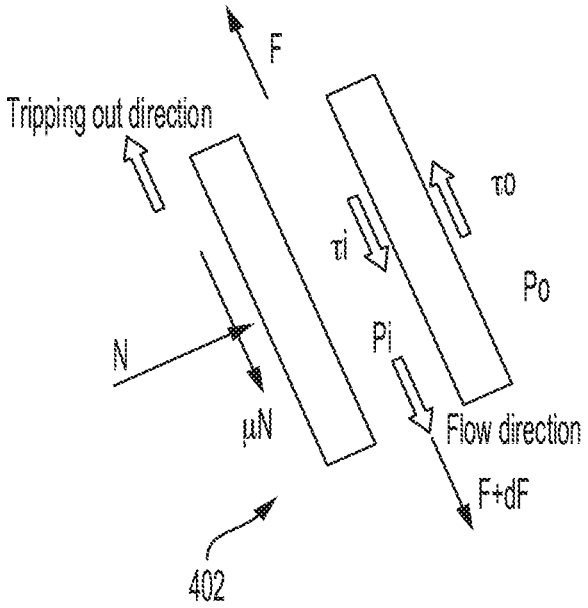
FIG. 4 is a schematic illustration of a segment of tubular string and some of the directions and flows that are used in a model for real-time torque and drag estimation according to some aspects of the disclosure.
Figure 5:
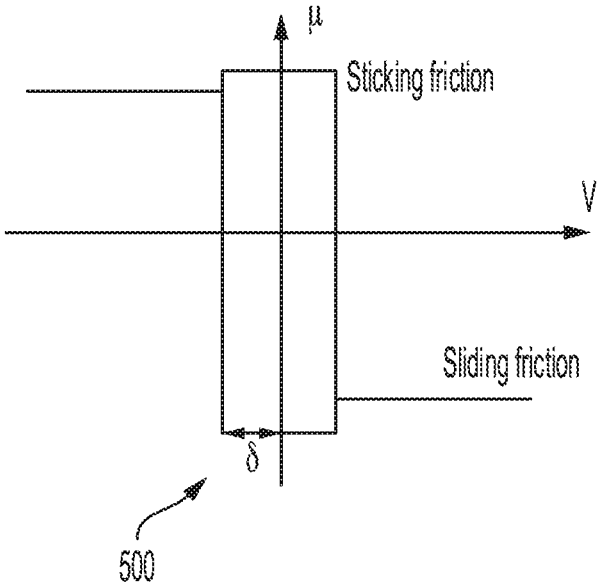
FIG. 5 is a graph showing frictional forces used in a model for real-time torque and drag estimation according to some aspects of the disclosure.

To provide a tubular vibration model, a segment 402 of tubular string as shown in FIG. 4 is represented in equation 1. The dynamic equation of a tubular string in fluid environment can be deduced on the basis of Newton's second law:

$$\frac{\partial F}{\partial s} + q_e\cos\varphi + \mu N + \pi\tau_{wi}D_i - \pi\tau_{wo}D_o = \rho_s A_s \frac{\partial v}{\partial t}. \tag{1}$$

F is the equivalent axial force on tubular string and calculated by:

$$F = F_a - P_i A_i + P_o A_o, \tag{2}$$

where $F_a$ is the actual axial force on the tubular string, $P_i$ and $P_o$ are the inner and annular pressures, $D_i$ and $D_o$ are the inner and outer diameters of tubular string, and $A_i$ and $A_o$ are the areas calculated from inner and outer diameters of tubular string.

In equation 1, $q_e$ is the equivalent tubular string weight per unit length and calculated by $$q_e = \rho_s A_s + \rho_i A_i - \rho_o A_o, \tag{3}$$

where $\rho_s$, $\rho_i$ and $\rho_o$ are the densities of tubular string, inner fluid and annular fluid, $A_s$ is the area of cross-section of tubular string. In equation 1, $\varphi$ is the inclination angle of well trajectory, $\mu$ is the friction factor between tubular string and wellbore surface, N is the contact force between tubular string and wellbore per unit length and calculated by:

$$N = \sqrt{\left(Fk + q_e n_z - \rho_s A_s\left(\frac{dv}{dt}\right)^2\right)^2 + (q_e b_z)^2}, \tag{4}$$

in which, k is the curvature of well trajectory, $n_z$ and $b_z$ are the normal and bi-normal Frenet-Serret unit vector components in the vertical direction, and v is the axial velocity of tubular string. The axial strain of tubular string under the effects of axial force and pressures is calculated by:

$$\frac{\partial u}{\partial s} = \frac{1}{EA_s}(F + (1 - 2\nu)(P_i A_i - P_o A_o)), \tag{5}$$

where $\upsilon$ is the Poisson ratio of tubular string. Substituting equation 5 into equation 1, one can obtain the vibration equation of the tubular string, $$\rho_s A_s \frac{\partial^2 u}{\partial r^2} = \frac{\partial}{\partial s}\left(EA_s \frac{\partial u}{\partial s}\right) + q_e\cos\varphi + \mu N + \pi\tau_{wi}D_i - \pi\tau_{wo}D_o \tag{6}$$

Simulation of friction force is difficult because of strongly nonlinear behavior when velocity direction of a tubing string changes. A small region of velocity near zero is defined as $|v|<\delta$ shown in graph 500 of FIG. 5. Outside this region, friction factor is expressed as the function of velocity, which corresponds to a sliding friction state. Inside the region, the friction force $F_f$ should be calculated first with an equilibrium equation. If the friction force is larger than the maximum sticking friction $F_s$, the friction factor is determined by velocity, and friction is based on a sliding state. If the friction force is smaller than the maximum sticking friction force, the friction factor is calculated from an equilibrium equation and friction is in a sticking state. Therefore, the value of friction factor can be obtained from equation 7:

$$\mu = \begin{cases} \text{calculating from equilibrim equation} & \text{if } |v| < \delta \text{ and } F_f \le F_s = \mu_s N \\ -\text{sign}(v)\mu_d & \text{else} \end{cases}, \tag{7}$$

in which, $\mu_d$ is the sliding friction factor, $\mu_s$ is the maximum sticking friction factor.

Figure 6:
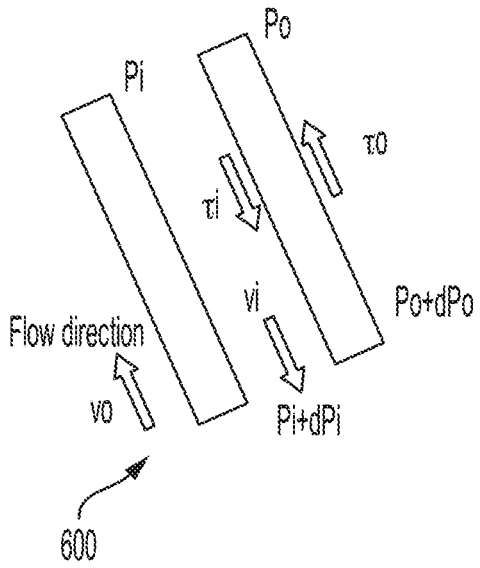
FIG. 6 is another schematic illustration of a segment of tubular string and some of the directions and flows that are used in a model for real-time torque and drag estimation according to some aspects of the disclosure.

For a fluid flow model, the inner and annular pressures are calculated, as illustrated by tubular segment 600 of FIG. 6, by the equations:

$$\frac{\partial P_i}{\partial s} = \rho_i g\cos\varphi - \frac{\lambda_i}{D_i}\frac{\rho_i v_i^2}{2} \tag{8}$$

$$\frac{\partial P_o}{\partial s} = \rho_0 g\cos\varphi + \frac{\lambda_o}{D_w - D_o}\frac{\rho_o v_o^2}{2}.$$

The shear forces on the inner and outer surfaces of tubular string due to fluid flow are calculated by the equations:

$$\tau_{wi} = \frac{\lambda_i}{4}\frac{\rho_i v_i^2}{2} \tag{10}$$

$$\tau_{wo} = \frac{\lambda_o}{4}\frac{\rho_0 v_o^2}{2}, \tag{11}$$

where $\lambda_i$ and $\lambda_o$ are the friction factors of inner and annular flows and calculated by:

$$\lambda_i = \begin{cases} \frac{64}{Re_i} & \text{laminar flow } (Re_i \le 2000) \\ \text{interpolation tranient flow } (2000 < Re_i \le 3000) \\ \frac{0.3164}{Re_i^{0.25}} & \text{tubulent flow } (Re_i > 3000) \end{cases} \tag{12}$$

$$\lambda_o = \begin{cases} \frac{96}{Re_o} & \text{laminar flow } (Re_o \le 2000) \\ \text{interpolation tranient flow } (2000 < Re_o \le 3000), \\ \frac{0.3164}{Re_o^{0.25}} & \text{tubulent flow } (Re_o > 3000) \end{cases} \tag{13}$$

where $Re_i$ and $Re_o$ are the Reynolds numbers for inner and annular flows. The calculation expressions of Reynolds numbers for Newton, Bingham and Power-law fluids are given in Table 1. Other fluid types can be modeled in a similar fashion.

TABLE 1

Calculation expressions of Re for different fluid types

| FLUID TYPE | $Re_i$ | $Re_o$ |
|---|---|---|
| NEWTON FLUID ($\tau = \mu\dot{\gamma}$) | $\frac{\rho_i v_i D_i}{\mu_i}$ | $\frac{\rho_o v_o (D_w - D_o)}{\mu_o}$ |
| BINGHAM FLUID ($\tau = \mu\dot{\gamma} + \tau_0$) | $\frac{\rho_i v_i D_i}{\mu_i\left(1 + \frac{\tau_{0i} D_i}{6\mu_i v_i}\right)}$ | $\frac{\rho_o v_o (D_w - D_o)}{\mu_o\left(1 + \frac{\tau_{0o}(D_w - D_o)}{8\mu_o v_o}\right)}$ |
| POWER LAW FLUID ($\tau = K\dot{\gamma}^n$) | $\frac{8^{1-n_i} D_i^{n_i} v^{2-n_i} \rho_i}{K_i\left(\frac{3n_i + 1}{4n_i}\right)^{n_i}}$ | $\frac{12^{1-n_o}(D_w - D_o)^{n_o} v^{2-n_o} \rho_o}{K_o\left(\frac{2n_o + 1}{3n_o}\right)^{n_o}}$ |

The calculation method includes a finite difference scheme. For the convenience of derivation, equation 1 can be expressed as:

$$\rho_s A_s \frac{\partial^2 u}{\partial t^2} = \frac{\partial}{\partial s}\left(EA_s \frac{\partial u}{\partial s}\right) + f + \mu N, \tag{14}$$

where, f is external load on the tubular string per unit length excepting friction force and calculated by $f=q_e \cos\varphi+\pi\tau_{wi}D_i-\pi\tau_{wo}D_o$.

Figure 7:
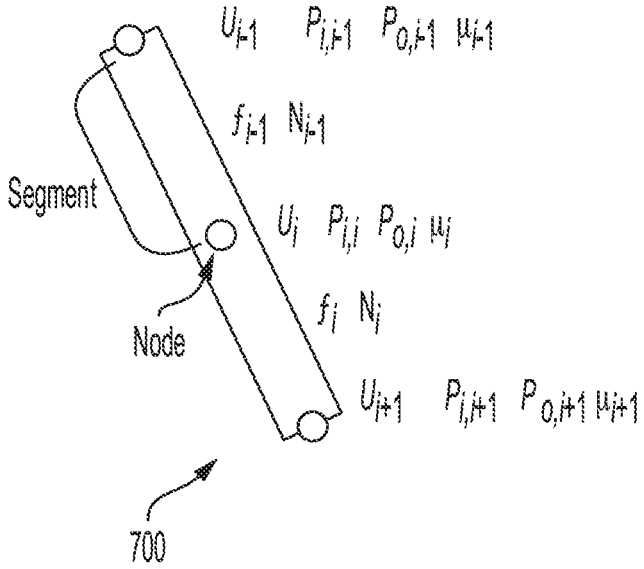
FIG. 7 is a graphical illustration of a segment of tubular string as modeled for real-time torque and drag estimation according to some aspects of the disclosure.

FIG. 7 shows the discretized parameters on segment 700 of a tubular string. A segment of tubular string includes two nodes, in which axial displacement $U_i$, pressures $P_{i,i}$, $P_{o,i}$ and friction factor $\mu_i$ are defined on nodes and external load $f_i$ and contact force $N_i$ are defined on segments. Therefore, the subscript "i" in $U_i$ represents the left node of i-th segment or the right node of (i−1)-th segment, and the subscript "i" in $f_i$ represents i-th segment. To capture the changes between sliding friction force and sticking friction force, a rather small time interval can be adopted in the finite difference calculation. Then, an explicit finite difference scheme is more proper for calculation, because algorithm stability can be ensured using small time intervals and less calculation time will be consumed by using the explicit scheme. Parameters and there values for the nodes of the tubing string can be stored in an element matrix for use in the calculations of the model.

With the definitions of discretized parameters above, the explicit central difference scheme of equation 14 can be expressed as:

$$(\rho_s A_s)_i \frac{U_i^{j+1} - 2U_i^j + U_i^{j-1}}{\Delta t^2} = (EA_s)_i \frac{U_{i+1}^j - 2U_i^j + U_{i-1}^j}{\Delta s_i^2} + \frac{f_{i-1}^j + fi^j}{2} + \mu_i^j \frac{N_{i-1}^j + N_i^j}{2}, \tag{15}$$

where, Δt is the time interval and the superscript "j" in $U_i^j$ represents the i-th time point.

The initial displacement satisfies equation 1 when the right side is set to 0. The discretized scheme of initial displacement condition can be expressed as:

$$U_i^1 = U_{initial}. \tag{16}$$

The discretized scheme for an initial velocity condition can be expressed as:

$$\frac{U_i^2 - U_i^0}{2\Delta t} = v_{initial}. \tag{17}$$

Note that, the term $U_i^0$ in equation 17 can be eliminated by combining equation 17 and equation 15 while j=1.

The top of the tubular string is tied to a hook, so that the axial displacement of the top of tubular string is equal to the vertical displacement of the hook. Thus, the top boundary condition is expressed as:

$$U_1^j = U_{hook}. \tag{18}$$

In a tripping in or out operation, the axial force on the bit is set to 0. In the drilling process, the axial force on the bit is determined with a bit-rock interaction model. For simplicity, the value of axial force on the bit is assumed and then the bottom boundary condition is expressed as:

$$(EA_s)_n \frac{U_{n+1}^j - U_{n-1}^j}{2\Delta s_n} = F_{bit}. \tag{19}$$

Note that, the term $U_{n+1}^j$ in equation 19 can be eliminated by combing equation 19 and equation 15 while i=n.

When two or more kinds of tubular strings are being used at the same time, the relevant parameters such as tubular diameter, weight, etc. are different for each kind of tubular string. The continuous conditions present at each node connecting one type of tubular string to another type of tubular string need to be satisfied. The equivalent axial forces on adjacent segments should be continuous. By combing the vibration equations on the two segments and continuous conditions on a connecting point, the finite difference scheme is expressed as:

$$\begin{aligned}\left(\frac{(\rho_s A_s)_{i-1}\Delta s_{i-1}}{2} + \frac{(\rho_s A_s)_i \Delta s_i}{2}\right)\frac{U_i^{j+1} - 2U_i^j + U_i^{j-1}}{\Delta t^2} = \\ (EA_s)_{i-1}\frac{U_{i-1}^j}{\Delta s_{i-1}} - \left(\frac{(EA_s)_{i-1}}{\Delta s_{i-1}} + \frac{(EA_s)_i}{\Delta s_i}\right)U_i^j + (EA_s)_i \frac{U_{i+1}^j}{\Delta s_i} + \\ \frac{\Delta s_{i-1}}{2} f_{i-1}^j + \frac{\Delta s_i}{2} f_i^j + \frac{\Delta s_{i-1}}{2}\mu_i^j N_{i-1}^j + \frac{\Delta s_i}{2}\mu_i^j N_i^j + \\ (1-2v_{i-1})\left(P_{i,i}^j A_{i,i-1} - P_{o,i}^j A_{o,i-1}\right) - (1-2v_i)\left(P_{i,i}^j A_{i,i} - P_{o,i}^j A_{o,i}\right).\end{aligned} \tag{20}$$

The values of the friction factor can be calculated with equation 7. For the sliding friction state, the friction factor is determined by velocity direction, namely $\mu_i^{j+1} = -\text{sign}(V_i^{j+1})\mu_d$, in which $V_i^{j+1}$ is the axial velocity of i-th node at the end of (j+1)-th time interval. For the sticking friction state, friction factor $\mu_i^{j+1}$ can be determined by equation 15 while letting the left side equal zero and setting the superscript j to j+1. If the absolute value of $\mu_i^{j+1}$ is larger than the maximum sticking friction factor $\mu_s$, the value of $\mu_i^{j+1}$ is calculated to include velocity direction, by $\mu_i^{j+1} = -\text{sign}(V_i^{j+1})\mu_d$.

To model fluid flow, the finite difference schemes of equations 8 and 9 can be expressed as:

$$\begin{aligned}\frac{P_{i,i+1}^{j+1} - P_{i,i}^{j+1}}{\Delta s_i} &= \rho_{i,i} g \cos\varphi_i - \frac{\lambda_{i,i}}{D_{i,i}} \frac{\rho_i v_{i,i}^2}{2} \\ \frac{P_{o,i+1}^{j+1} - P_{o,i}^{j+1}}{\Delta s_i} &= \rho_{o,i} g \cos\varphi_i + \frac{\lambda_{o,i}}{D_{w,i} - D_{o,i}} \frac{\rho_o v_{o,i}^2}{2}.\end{aligned} \tag{21}$$

If the pump rate is known, the inner and annular flow velocities can be calculated from equations 21 and 22. Once the annular back pressure $P_{o,1}^j$ is known, the distribution of annular pressure along the wellbore can be obtained with equation 22. By setting the inner pressure equal to annular pressure at the drill bit, the distribution of inner pressure along the wellbore can be obtained with equation 21.

Figure 8:
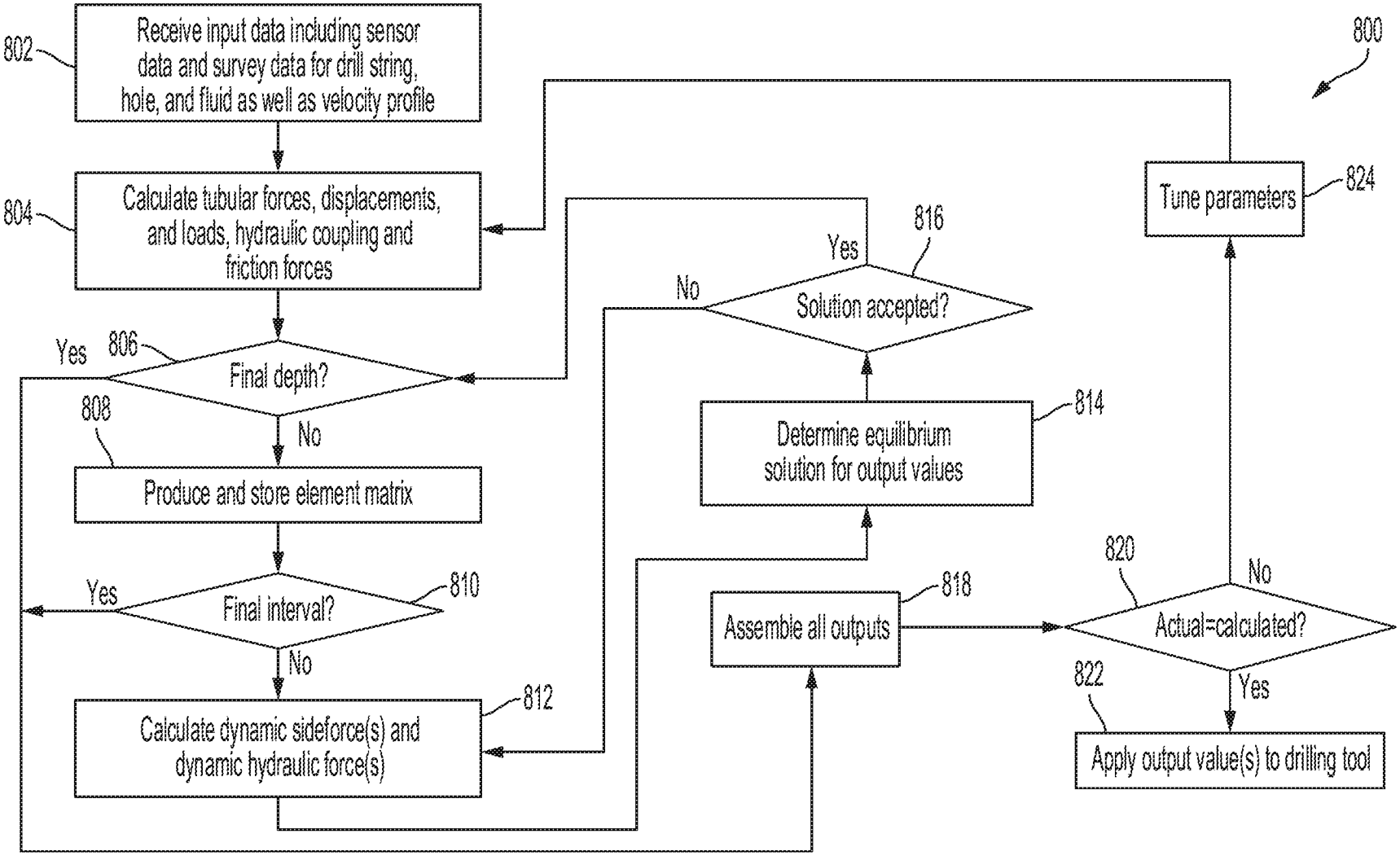
FIG. 8 is another flowchart of a process for real-time torque and drag estimation according to some aspects of the disclosure.

FIG. 8 is a flowchart of a process for real-time torque and drag estimation according to some aspects of the disclosure. Process 800 as illustrated in FIG. 8 provides output values to a drilling tool by making use of the dynamic model 212, an example of which is described above. At block 802, computing device 140 receives input data including sensor data from sensor 109 and stored survey data for the drill string, hole, and fluid. The computing device also receives a velocity profile determined in accordance with the model. At block 804, computing device 140 calculates tubular forces, displacements and loads, hydraulic coupling and friction forces.

The basis for displacement-based tubular calculations can be broken down into four categories: tubular forces, displacements, and loads; hydraulics coupling; friction force magnitude and direction; and tubular forces and displacements. Tubular forces are determined by pressures, tubular weight, external mechanical forces, and friction. The axial force varies with depth due to the tubular weight and friction as given by:

$$F_a' = w_e \cos \phi + g(u,u_o)\mu W_n, \tag{23}$$

where $F_a$ is the axial force with positive values indicating tensile force, is d/dz with measured from the surface, $W_e$ is the effective tubular weight per foot, φ is the angle of inclination of the wellbore with the vertical, μ is the friction coefficient, $W_n$ is the contact force between the tubing and the casing, and g is a function of current displacement μ and initial displacement $\mu_0$, defining the friction force. The friction is positive for incremental tubular movement upward, and negative for incremental tubular movement downward (such as landing the tubular). The contact force depends on the buoyant weight of the tubular plus the effect of buckling. The frictional force is not easy to calculate because it depends on the load and displacement history of the tubular string.

The classic Coulomb friction model between rigid surfaces is defined by the following criteria:

$$f = \mu_d N \; du > 0$$

$$-\mu_s N < f < \mu_s N \; du = 0$$

$$f = \mu_d N \; du < 0, \tag{24}$$

Where du is the incremental displacement, $\mu_d$ is the dynamic friction coefficient, $\mu_s$ is the static friction coefficient, and N is the contact force. Typically, the static friction coefficient is greater than the dynamic friction coefficient, but to simplify analysis the static friction coefficient can be assumed to be identical to the dynamic friction coefficient. One issue may be the indeterminacy of the friction force for zero incremental displacement. A real loading situation may be considered to generate an incremental displacement. But, a case in which there is no change in loading may create an indeterminate situation.

Continuing with FIG. 8, at block 806 a determination is made as to whether the drilling tool has reached its final depth. If not, the element matrix is produced and stored at block 808, for example, in memory 207. At block 810 a determination is made as to whether the current time interval is the last time interval. If not, the computing device calculate dynamic sideforce or dynamic sideforces and dynamic, hydraulic force or dynamic hydraulic forces at block 812. The parameters calculated for dynamic sideforce can include elasticity and friction and can include both static and dynamic values and the values for a reversal of the drill string if needed. The parameters calculated for dynamic, hydraulic force can include viscous shear, eccentricity, gelation, wellbore expansion, and pipe expansion. The term dynamic as used to refer to these forces invokes that the forces are calculated with respect to time interval, where the forces may change from one time interval to another. Dynamic force values are used in the model as opposed to force values that are determined once and assumed to be static over time.

Still referring to FIG. 8, the computing device determines an equilibrium solution for the output values at block 814. Optionally, at block 816, information about the equilibrium solution can be presented to an operator at block 816, and the forces can be recalculated at block 812 if necessary. Otherwise, if the drilling tool has reached the final depth at block 806 or the final time interval has been reached at block 810, control output values are assembled at block 818. Optionally, at block 820, one or more actual parameter values sampled by sensors for the various forces can be compared to calculated parameters for forces at block 812. Parameters can be tuned at block 824 and the process 800 can be repeated if the forces do not match. Otherwise, the output values are applied to the drilling tool at block 822. Since the model is a transient model, it can be used to control a drill bit autonomously from downhole or from the surface. The process can be based on calculations made at the surface, at the drill bit, or in between.

Figure 9:
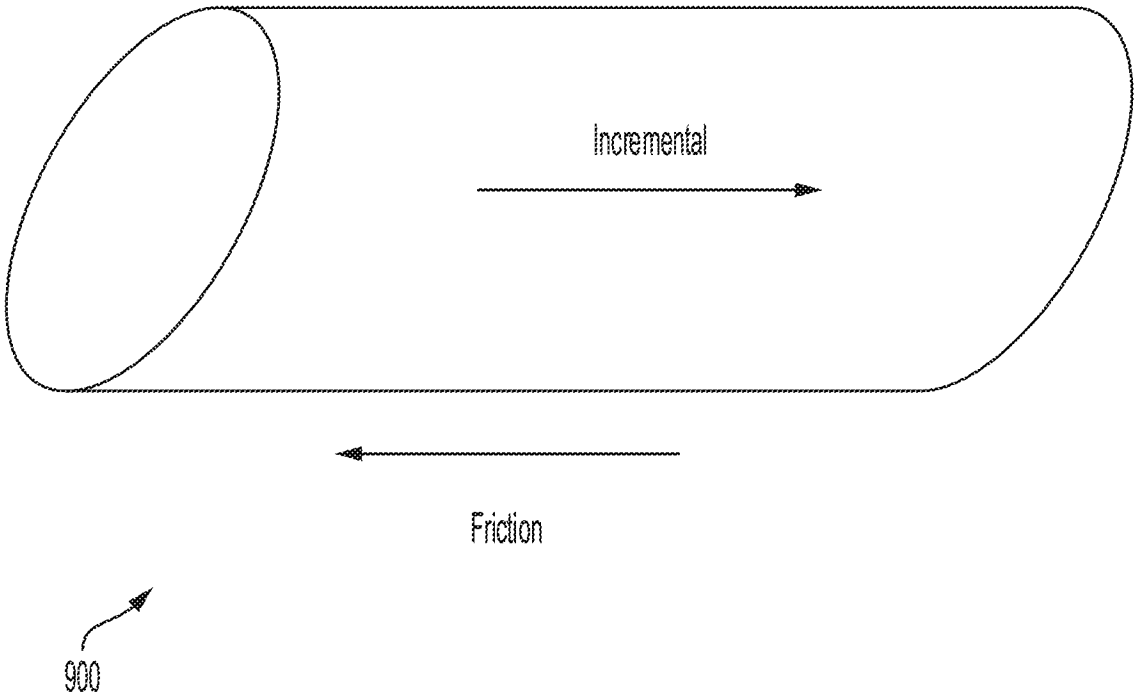
FIG. 9 is another schematic illustration of a segment of tubular string and some of the forces that are used in a model for real-time torque and drag estimation according to some aspects of the disclosure.
Figure 10:
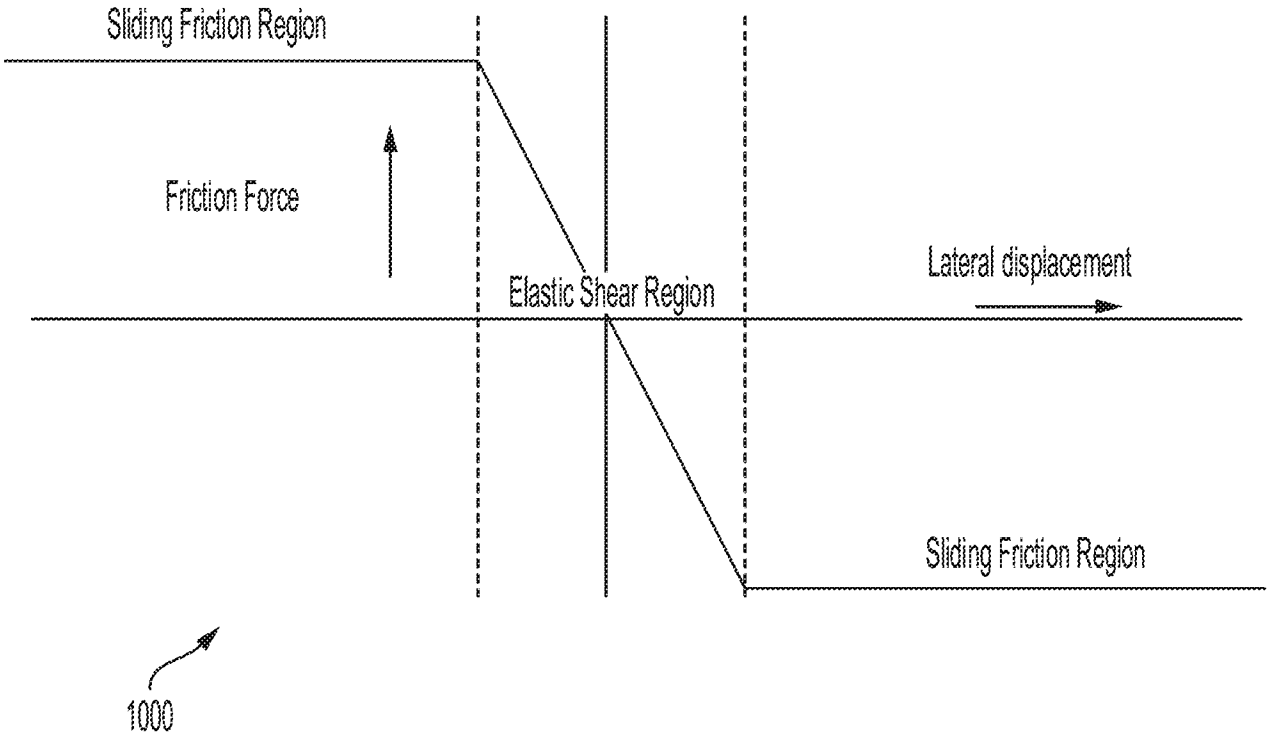
FIG. 10 is a graph showing forces and displacements used in a model for real-time torque and drag estimation according to some aspects of the disclosure.

One consideration in modeling the tubular is that the tubulars in question are not rigid, but rather, they are elastic. This consideration helps considerably, because it removes the indeterminacy in the friction force. Because the tubular is elastic, there is a displacement associated with the static friction case, for if the pipe surface is held by static friction, the pipe can still displace due to elastic shear. FIG. 9 is schematic illustration of a segment 900 of tubular string and that illustrates this concept. The amount of static friction force generated is proportional to the shear displacement of the pipe. When the shear force exceeds the sliding friction force, the pipe slides and the friction force becomes constant. The friction force model includes three regions, a linear force-displacement region around the zero displacement point, and two constant friction force zones outside this linear region, representing sliding friction. FIG. 10 is a graph 1000 showing forces and displacements following these regions.

Figure 11:
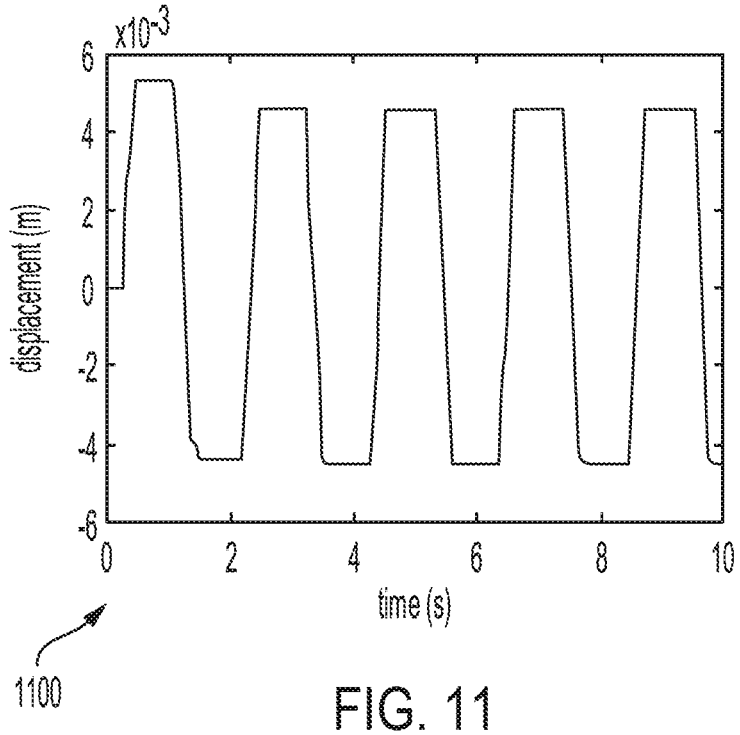
FIG. 11, FIG. 12, and FIG. 13 are examples of graphs of motion signatures for portions of a tubular drilling string or tool attached to a tubular string according to some aspects of the disclosure.
Figure 12:
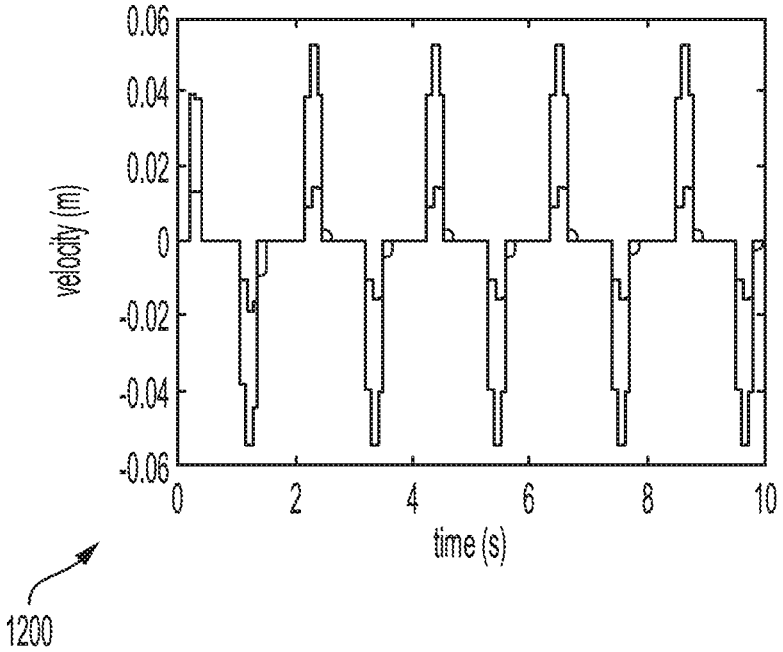
Figure 13:
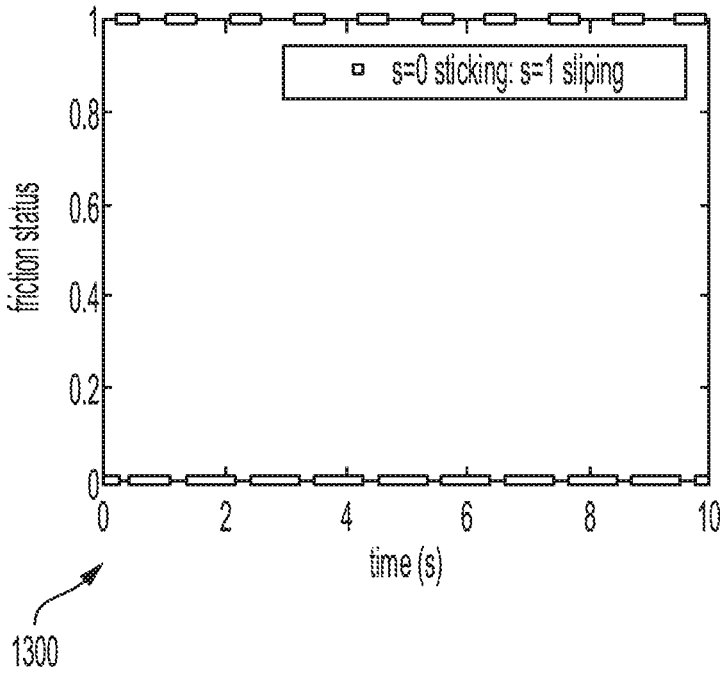

The friction model includes different forces applied to typical displacement, velocity and block (friction status) signatures. FIG. 11, FIG. 12, and FIG. 13 are graphs of typical motion signatures for portions of a tubular drilling string or tool attached to a tubular string. FIG. 11 shows graph 1100, which is a displacement signature, FIG. 12 shows graph 1200, which is a velocity signature, and FIG. 13 shows graph 1300, which is a motion status signature. Complex mechanical behaviors of tubular string may not be revealed with the introduction of the static model or the absence of elasticity assumption. To overcome this shortcoming, the above assumption has been removed in the dynamic model. In the dynamic model, the kinetic equation for the tubular string is also expressed as below. Values of $v_t$ cannot be determined in advance. Where u is the axial displacement of the tubular string:

$$F_t = EA\frac{du}{ds} \tag{25}$$

$$v_t = \frac{du}{dt}.$$

A wave equation can be solved based on equation 25 by using a finite difference method:

$$\rho A\frac{d^2u}{dt^2} - EA\frac{d^2u}{ds^2} = h(\underline{s,t}). \tag{26}$$

After obtaining u from equations 24 and 25, axial force and velocity can be calculated.

Figure 14:
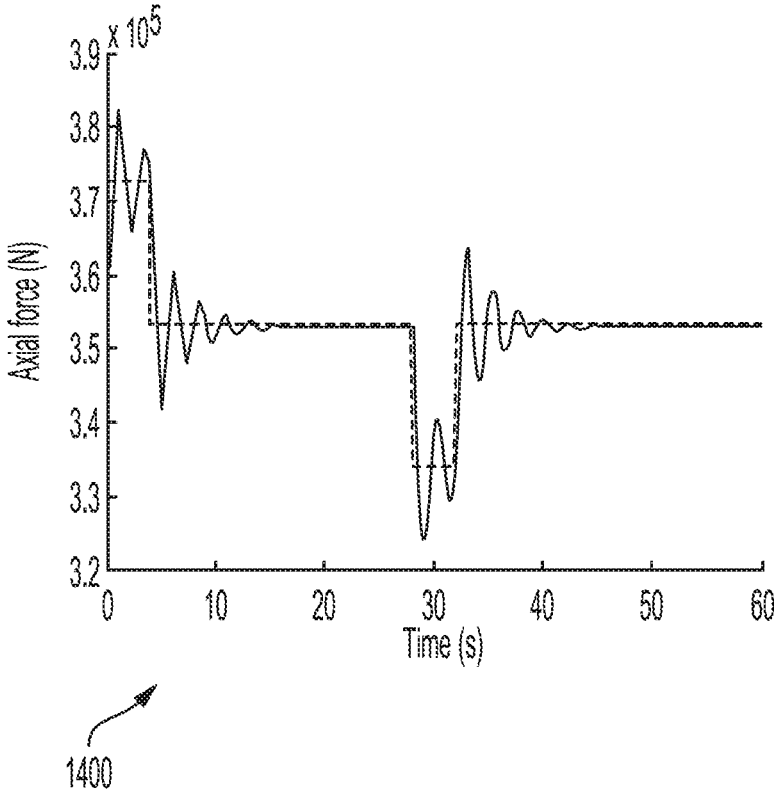
FIG. 14 is an example of a graph of axial forces as predicted by different models, including a dynamic model for real-time torque and drag estimation according to some aspects of the disclosure.
Figure 16:
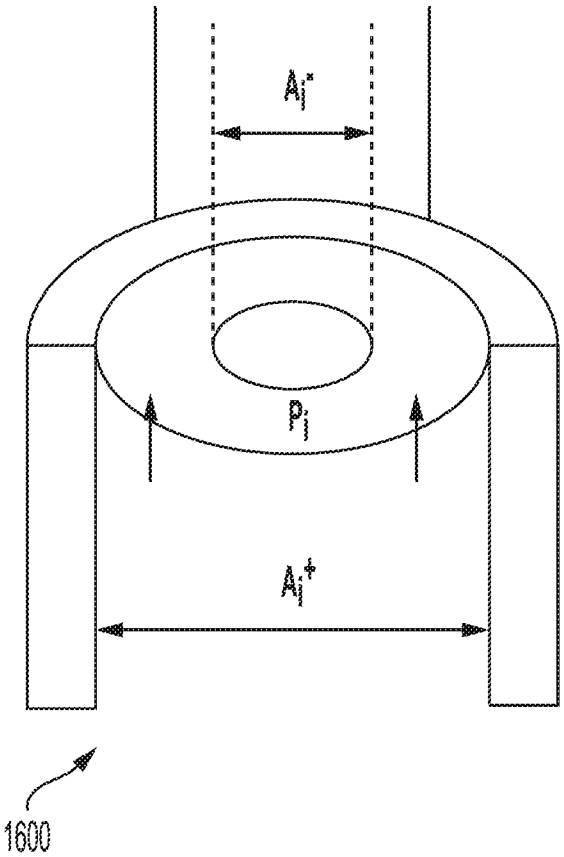
FIG. 15 and FIG. 16 are schematic illustrations of hydraulic forces taken into account by a dynamic model for real-time torque and drag estimation according to some aspects of the disclosure.
Figure 15:
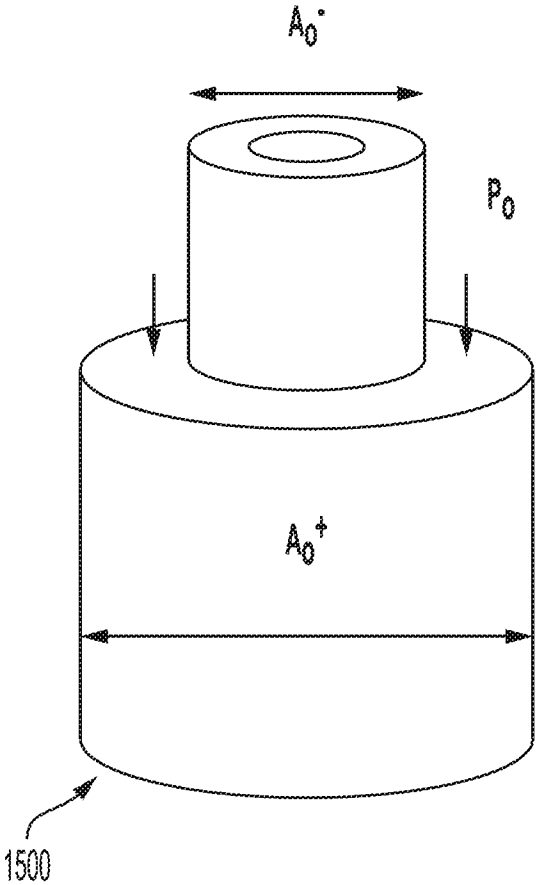

The dynamic model also includes Poisson's effect, which causes the pipe to shorten with increased inside pressure and lengthen with increased outside pressure. Increased outside pressure also causes increased viscous drag. Poisson's effect can be represented by the equation:

$$2\mu A\frac{\partial p}{\partial s} + 2\pi r\tau, \tag{27}$$

Where μ is Poisson's ratio and τ is the fluid friction shear stress. An example of axial force over time with the dynamic model superimposed on an older model is shown as graph 1400 of FIG. 14. The solid line represents the data from the dynamic model and the dotted line represents the data from the older model. The external pressure dynamic force taken into account by the model is shown in schematic representation 1500 of FIG. 15. The internal pressure force taken into account by the dynamic model is shown in schematic representation 1600 of FIG. 16.

Figure 17:
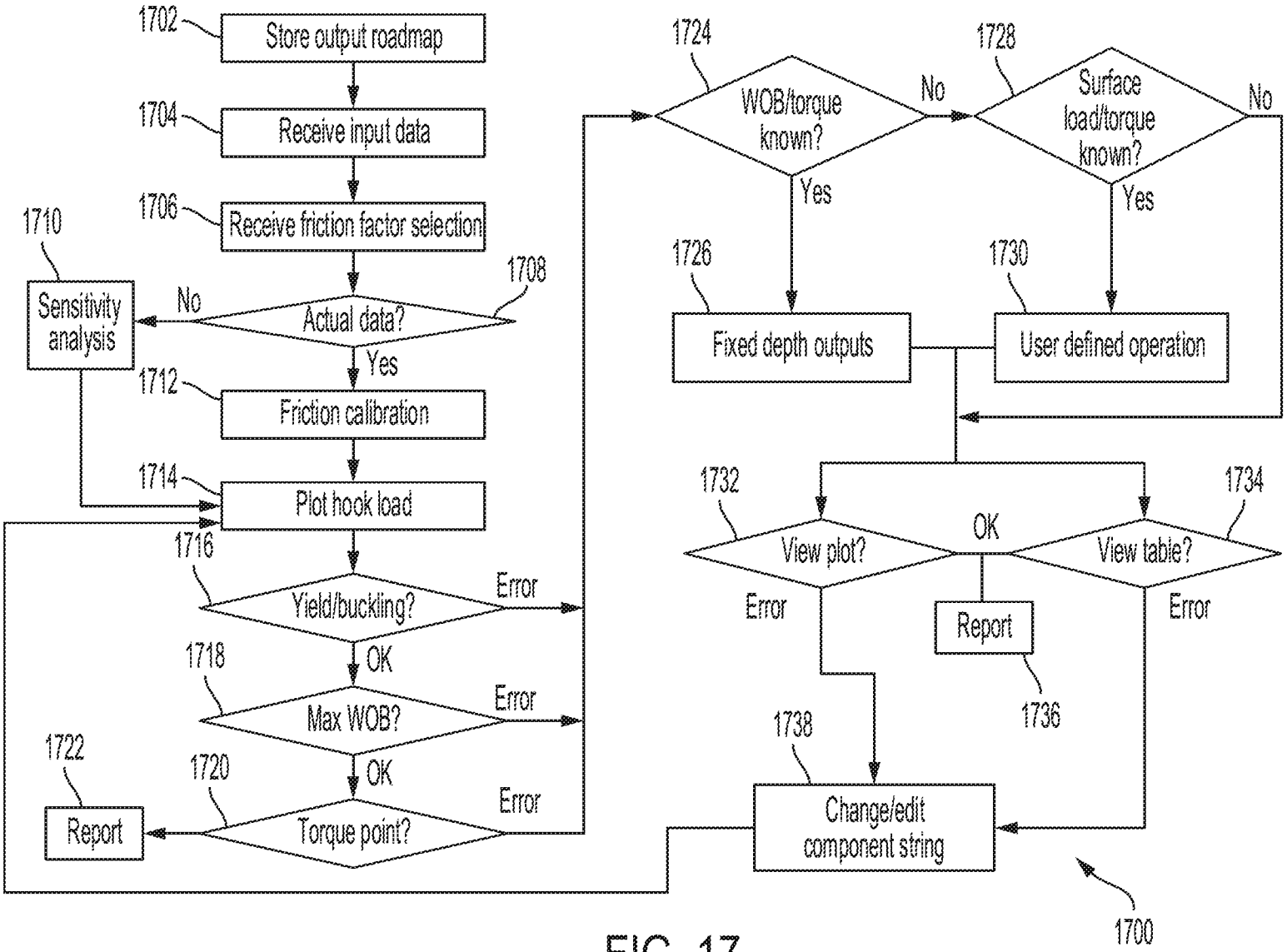
FIG. 17 is a flowchart of a process for interacting with a computing device running a real-time torque and drag dynamic estimation model according to some aspects of the disclosure.

FIG. 17 is a flowchart of a process 1700 for interacting with the real-time torque and drag dynamic model 212 running on computing device 140 according to some aspects of the disclosure. In process 1700, the model is being used in an advisory capacity. The model can be used in this capacity while controlling a drilling tool, or the drilling tool can be engaged with the process of FIG. 8 before or after the model is run with the process of FIG. 17. At block 1702, computing device 140 establishes and stores a roadmap of the various outputs to be determined based upon the type of drilling tool to be used or the formation or orientation of the drill string, or a combination of these factors. These factors can be established by operator input through I/O interface 232 defining the components of the drill string. At block 1704, the computing device 140 receives input data. The input data can be received from sensors 109 or can be simulated. At block 1706, computing device 140 receives a friction factor to be used for the model. This friction factor can be provided by user selection or may have been previously stored. At block 1708, process 1700 branches to perform a sensitivity analysis at block 1710 of the data input above was simulated data, or a friction calibration at block 1712 if the data input above is actual sensor data. At block 1714, computing device 140 plots and stores a predicted hookload for the drill string at various depths.

Still referring to FIG. 17, at block 1716, a determination is made as to whether the hookload at any point would cause yield or buckling of the tubular string. At block 1718, a determination is made as to whether the maximum WOB for the drilling tool would be exceeded. At block 1720, a determination is made as to whether the maximum torque point for the drilling tool or drillstring will be reached. If none of these errors would occur, a report is produced at block 1722. If any of these errors would occur, a determination is made at block 1724 as to whether the WOB, torque, or both are known for various depths downhole. If so, output values at fixed depths are provided at block 1726 by computing device 140. If not, a determination is made at block 1728 as to whether the torque and load at the surface are known. If so, user defined operating parameters are provided to the model at block 1730, for example, to an operator.

Continuing with FIG. 17, at blocks 1732 and 1734, the user can chose to plot and display a graph or graphs, and to display a table or tables, respectively. These can be provided by computing device 140 using a display connected to I/O interface 232. A report including the selected graphs and tables can be produced at block 1736. In some examples, the plotted data can be used to graph effective tension, torque, fatigue, or stress at various depths. In some examples, the displayed tables can include tables showing maximum overpull, slack-off, or failures at various depths. If errors occur, these can be reported to the operator and the components of the string or the drilling tool can be edited or changed to change the parameters being used by the model at block 1738.

Terminology used herein is for describing particular embodiments only and is not intended to be limiting. As used herein, the singular forms "a," "an," and "the" are intended to include the plural forms as well, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof. Additionally, comparative, quantitative terms such as "above," "below," "less," and "greater" are intended to encompass the concept of equality, thus, "less" can mean not only "less" in the strictest mathematical sense, but also, "less than or equal to."

Unless specifically stated otherwise, it is appreciated that throughout this specification that terms such as "processing," "calculating," "determining," "operations," or the like refer to actions or processes of a computing device, such as the controller or processing device described herein, that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "connected," "connectable," or with similar terms can be connected directly or through intervening elements.

In some aspects, a system for monitoring drill cuttings is provided according to one or more of the following examples. As used below, any reference to a series of examples is to be understood as a reference to each of those examples disjunctively (e.g., "Examples 1-4" is to be understood as "Examples 1, 2, 3, or 4").

Example 1. A system includes at least one sensor disposable with respect to a drillstring in a wellbore, a drilling tool, a processor communicatively coupled to the sensor and the drilling tool, and a non-transitory memory device including instructions that are executable by the processor to cause the processor to perform operations. The operations include receiving input data at least in part using the sensor, the input data corresponding to characteristics of at least one of drilling fluid, the drillstring, or the wellbore, calculating at least one dynamic sideforce and at least one dynamic, hydraulic force for each time interval of a plurality of time intervals based at least in part on the input data; determining an equilibrium solution for an output value using the at least one dynamic sideforce and at least one dynamic, hydraulic force for each time interval of the plurality of time intervals, and applying the output value to the drilling tool for each time interval of the plurality of time intervals.

Example 2. The system of example 1 wherein the operations further include producing an element matrix and wherein the at least one dynamic sideforce and the at least one dynamic, hydraulic force are calculated using the element matrix.

Example 3. The system of example(s) 1-2 wherein the operations further include tuning at least one of hydraulic parameters or sideforce parameters when an actual parameter value is substantially unequal to a calculated parameter value.

Example 4. The system of example(s) 1-3 wherein the hydraulic parameters include at least one of viscous shear, eccentricity, gelation, wellbore expansion or pipe expansion and the sideforce parameters include at least one of elasticity or friction.

Example 5. The system of example(s) 1-4 wherein the operations further include determining hookload based on the output value, the at least one dynamic sideforce, and the at least one dynamic, hydraulic force, and displaying a plot of the hookload.

Example 6. The system of example(s) 1-5 wherein the operations further include displaying a graph of at least one of effective tension, torque, fatigue, or stress.

Example 7. The system of example(s) 1-6 wherein the operations further include displaying a table of at least one of maximum overpull, slack-off, or failures.

Example 8. A non-transitory computer-readable medium that includes instructions that are executable by a processor for causing the processor to perform operations related to estimating torque and drag on a drilling tool. The operations include receiving input data corresponding to characteristics of at least one of drilling fluid, a drillstring, or a wellbore, calculating at least one dynamic sideforce and at least one dynamic, hydraulic force for each time interval of a plurality of time intervals based at least in part on the input data, determining an equilibrium solution for an output value using the at least one dynamic sideforce and at least one dynamic, hydraulic force for each time interval of the plurality of time intervals, and applying the output value to a drilling tool for each time interval of the plurality of time intervals.

Example 9. The non-transitory computer-readable medium of example 8 wherein the operations further include producing an element matrix and wherein the at least one dynamic sideforce and the at least one dynamic, hydraulic force are calculated using the element matrix.

Example 10. The non-transitory computer-readable medium of example(s) 8-9 wherein the operations further include tuning at least one of hydraulic parameters or sideforce parameters and wherein hydraulic parameters include at least one of viscous shear, eccentricity, gelation, wellbore expansion or pipe expansion and the sideforce parameters include at least one of elasticity or friction.

Example 11. The non-transitory computer-readable medium of example(s) 8-10 wherein the operations further include determining hookload based on the output value, the at least one dynamic sideforce, and the at least one dynamic, hydraulic force, and displaying a plot of the hookload.

Example 12. The non-transitory computer-readable medium of example(s) 8-11 wherein the operations further include displaying a graph of at least one of effective tension, torque, fatigue, or stress.

Example 13. The non-transitory computer-readable medium of example(s) 8-12 wherein the operations further include displaying a table of at least one of maximum overpull, slack-off, or failures.

Example 14. A method includes receiving, by a processor, input data corresponding to characteristics of at least one of drilling fluid, a drillstring, or a wellbore, calculating, by the processor, at least one dynamic sideforce and at least one dynamic, hydraulic force for each time interval of a plurality of time intervals based at least in part on the input data, determining, by the processor, an equilibrium solution for an output value using the at least one dynamic sideforce and at least one dynamic, hydraulic force for each time interval of the plurality of time intervals, and applying, by the processor, the output value to a drilling tool for each time interval of the plurality of time intervals.

Example 15. The method of example 14 further includes producing an element matrix and wherein the at least one dynamic sideforce and the at least one dynamic, hydraulic force are calculated using the element matrix.

Example 16. The method of example(s) 14-15 further includes tuning at least one of hydraulic parameters or sideforce parameters when an actual parameter value is substantially unequal to a calculated parameter value.

Example 17. The method of example(s) 14-16 wherein the hydraulic parameters include at least one of viscous shear, eccentricity, gelation, wellbore expansion or pipe expansion and the sideforce parameters include at least one of elasticity or friction.

Example 18. The method of example(s) 14-17 further includes determining hookload based on the output value, the at least one dynamic sideforce, and the at least one dynamic, hydraulic force, and displaying a plot of the hookload.

Example 19. The method of example(s) 14-18 further includes displaying a graph of at least one of effective tension, torque, fatigue, or stress.

Example 20. The method of example(s) 14-19 further includes displaying a table of at least one of maximum overpull, slack-off, or failures.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A system comprising:

a drilling tool;

a processor; and a non-transitory memory device comprising instructions that are executable by the processor to cause the processor to perform operations comprising:

receiving input data that corresponds to characteristics of at least one of drilling fluid, a drillstring, or a wellbore;

calculating at least one dynamic sideforce and at least one dynamic, hydraulic force based at least in part on the input data;

determining an equilibrium solution for an output value using the at least one dynamic sideforce and at least one dynamic, hydraulic force; and applying the output value to the drilling tool for controlling operation of the drilling tool.

2. The system of claim 1, wherein the operations further comprise producing an element matrix, wherein the operation of calculating the at least one dynamic sideforce and the at least one dynamic, hydraulic force comprises calculating the at least one dynamic sideforce and the at least one dynamic, hydraulic force using the element matrix.

3. The system of claim 1, wherein the operations further comprise tuning at least one of hydraulic parameters or sideforce parameters in response to determining that an actual parameter value is substantially unequal to a calculated parameter value.

4. The system of claim 3, wherein the hydraulic parameters comprise at least one of viscous shear, eccentricity, gelation, wellbore expansion or pipe expansion, wherein the sideforce parameters comprise at least one of elasticity or friction, and wherein the at least one of hydraulic parameters or the sideforce parameters are usable for re-determining the equilibrium solution for a new output value.

5. The system of claim 1, wherein the operations further comprise:

determining a hookload based on the output value, the at least one dynamic sideforce, and the at least one dynamic, hydraulic force; and displaying a plot of the hookload to an operator for drilling at various depths.

6. The system of claim 1, wherein the operations further comprise:

displaying a graph of at least one of effective tension, torque, fatigue, or stress at least in part using a sensor communicatively coupled to the processor, wherein the graph is usable for controlling operation of the drillstring or the drilling fluid.

7. The system of claim 1, wherein the operations further comprise:

displaying a table of at least one of maximum overpull, slack-off, or failures at least in part using a sensor communicatively coupled to the processor, wherein the table is usable for controlling operation of the drillstring or the drilling fluid.

8. A non-transitory computer-readable medium that includes instructions that are executable by a processor for causing the processor to perform operations, the operations comprising:

receiving input data corresponding to characteristics of at least one of drilling fluid, a drillstring, or a wellbore;

calculating at least one dynamic sideforce and at least one dynamic, hydraulic force based at least in part on the input data;

determining an equilibrium solution for an output value using the at least one dynamic sideforce and at least one dynamic, hydraulic force; and applying the output value to a drilling tool for controlling operation of the drilling tool for controlling operation of the drilling tool.

9. The non-transitory computer-readable medium of claim 8 wherein the operations further comprise producing an element matrix, wherein the operation of calculating the at least one dynamic sideforce and the at least one dynamic, hydraulic force comprises calculating the at least one dynamic sideforce and the at least one dynamic, hydraulic force using the element matrix.

10. The non-transitory computer-readable medium of claim 8, wherein the operations further comprise tuning at least one of hydraulic parameters or sideforce parameters and the hydraulic parameters comprise at least one of viscous shear, eccentricity, gelation, wellbore expansion or pipe expansion, wherein the sideforce parameters comprise at least one of elasticity or friction, and wherein the at least one of hydraulic parameters or the sideforce parameters are usable for re-determining the equilibrium solution for a new output value.

11. The non-transitory computer-readable medium of claim 8, wherein the operations further comprise:

determining a hookload based on the output value, the at least one dynamic sideforce, and the at least one dynamic, hydraulic force; and displaying a plot of the hookload to an operator for drilling at various depths.

12. The non-transitory computer-readable medium of claim 8, wherein the operations further comprise:

displaying a graph of at least one of effective tension, torque, fatigue, or stress at least in part using a sensor communicatively coupled to the processor, wherein the graph is usable for controlling operation of the drillstring or the drilling fluid.

13. The non-transitory computer-readable medium of claim 8, wherein the operations further comprise:

displaying a table of at least one of maximum overpull, slack-off, or failures at least in part using a sensor communicatively coupled to the processor, wherein the table is usable for controlling operation of the drillstring or the drilling fluid.

14. A method comprising:

receiving, by a processor, input data corresponding to characteristics of at least one of drilling fluid, a drillstring, or a wellbore;

calculating, by the processor, at least one dynamic sideforce and at least one dynamic, hydraulic force based at least in part on the input data;

determining, by the processor, an equilibrium solution for an output value using the at least one dynamic sideforce and at least one dynamic, hydraulic force; and applying, by the processor, the output value to a drilling tool for controlling operation of the drilling tool.

15. The method of claim 14, further comprising producing an element matrix, wherein the operation of calculating the at least one dynamic sideforce and the at least one dynamic, hydraulic force comprises calculating the at least one dynamic sideforce and the at least one dynamic, hydraulic force using the element matrix.

16. The method of claim 14, further comprising tuning at least one of hydraulic parameters or sideforce parameters in response to determining that an actual parameter value is substantially unequal to a calculated parameter value.

17. The method of claim 16, wherein the hydraulic parameters comprise at least one of viscous shear, eccentricity, gelation, wellbore expansion or pipe expansion, wherein the sideforce parameters comprise at least one of elasticity or friction, and wherein the at least one of hydraulic parameters or the sideforce parameters are usable for re-determining the equilibrium solution for a new output value.

18. The method of claim 14, further comprising:

determining a hookload based on the output value, the at least one dynamic sideforce, and the at least one dynamic, hydraulic force; and displaying a plot of the hookload to an operator for drilling at various depths.

19. The method of claim 14, further comprising:

displaying a graph of at least one of effective tension, torque, fatigue, or stress at least in part using a sensor communicatively coupled to a processor, wherein the graph is usable for controlling operation of the drill-string or the drilling fluid.

20. The method of claim 14, further comprising:

displaying a table of at least one of maximum overpull, slack-off, or failures at least in part using a sensor communicatively coupled to a processor, wherein the table is usable for controlling operation of the drill-string or the drilling fluid.

* * * * *